US009834412B2

(12) United States Patent
Roivainen et al.

(10) Patent No.: US 9,834,412 B2
(45) Date of Patent: Dec. 5, 2017

(54) ELEVATOR CAR ARRANGEMENT AND A CONNECTION ELEMENT

(71) Applicant: KONE Corporation, Helsinki (FI)

(72) Inventors: Gabriela Roivainen, Hyvinkää (FI); Mikko Vesterinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 101 days.

(21) Appl. No.: 14/948,933

(22) Filed: Nov. 23, 2015

(65) Prior Publication Data

US 2016/0167926 A1 Jun. 16, 2016

(30) Foreign Application Priority Data

Dec. 15, 2014 (EP) ..... 14197903

(51) Int. Cl.
*B66B 11/02* (2006.01)

(52) U.S. Cl.
CPC ..... *B66B 11/0273* (2013.01)

(58) Field of Classification Search
CPC ..... B66B 11/0266; B66B 11/0273
See application file for complete search history.

(56) References Cited

U.S. PATENT DOCUMENTS 2,076,034 A * 4/1937 Lampman ..... B60K 5/1208 248/605
2,145,952 A * 2/1939 Rayn ..... B60R 19/28 293/137
2,660,387 A * 11/1953 Roy ..... F16F 1/3615 248/574
3,177,032 A * 4/1965 Jaskowiak ..... B60G 99/004 296/35.1

(Continued)

FOREIGN PATENT DOCUMENTS

CN 201427831 Y 3/2010
JP 5-40275 U 5/1993

(Continued)

OTHER PUBLICATIONS

JPH0540275U English Translation.*

*Primary Examiner* — Minh Truong
(74) *Attorney, Agent, or Firm* — Birch, Stewart, Kolasch & Birch, LLP

(57) ABSTRACT

An elevator car arrangement includes an elevator car body including a roof, a bottom and side walls, and an elevator car sling for being guided along vertically extending guide rails. The elevator car sling includes at least a first vertical side support, a second vertical side support and an upper horizontal support, which supports are connected to each other to form the sling. The elevator car body is connected to the elevator car sling such that the elevator car body is supported in the elevator car sling. The elevator car arrangement further includes a connection element for connecting the elevator car body to the elevator car sling such that the connection element is arranged between the roof of the elevator car body and the vertical side support of the elevator car sling, the connection element including a damper for damping vibrations caused by guide rails. A connection element for connecting an elevator car body to an elevator car sling is provided to form the elevator car arrangement.

8 Claims, 3 Drawing Sheets

(56) References Cited

U.S. PATENT DOCUMENTS

| | | | | | |
|---|---|---|---|---|---|
| 3,706,468 | A * | 12/1972 | Yoviene | B60R 19/18 | 267/140 |
| 4,014,588 | A * | 3/1977 | Kohriyama | B60G 99/004 | 267/141.4 |
| 4,428,460 | A * | 1/1984 | Luinstra | B66B 11/0273 | 187/411 |
| 4,660,682 | A * | 4/1987 | Luinstra | B66B 11/0293 | 187/313 |
| 5,005,671 | A | 4/1991 | Aime et al. | | |
| 5,409,283 | A * | 4/1995 | Ban | B62D 24/02 | 180/312 |
| 6,604,735 | B2 * | 8/2003 | McCollough | F16F 1/373 | 267/140 |
| 8,167,283 | B2 * | 5/2012 | Huprikar | F16F 1/37 | 267/141.2 |

FOREIGN PATENT DOCUMENTS

| | | | | |
|---|---|---|---|---|
| JP | H-0540275 U * | 5/1993 | B66B 11/02 | |
| JP | 6-199487 A | 7/1994 | | |

* cited by examiner

ELEVATOR CAR ARRANGEMENT AND A CONNECTION ELEMENT

FIELD OF THE INVENTION

The invention relates to an isolation of an elevator car, in particular to an arrangement for isolating elevator car from vibrations coming from guide rails for improving ride comfort of an elevator.

BACKGROUND OF THE INVENTION

Usually in elevators the elevator car is generally fitted inside an elevator car sling, which the elevator car sling is suspended by hoisting roping and fitted to travel along guide rails. The guide rails are formed by connecting successive guide rail members together such that joints are formed in the assembled guide rails. These joints and possible impreciseness in guide rail alignment causes vibrations to the elevator car body via the elevator car sling connected to the elevator car body. This means that ride comfort in the elevator suffers and noise increases, which is especially the case with high speed elevators. Ride comfort for high speed elevators is very much influenced by the interface between the elevator car and the sling.

Means for damping oscillations in an elevator car is presented in U.S. Pat. No. 5,005,671 which shows an apparatus for isolating horizontal shocks, generated in high speed elevators by inaccurately aligned guide rails, from the elevator car body. The apparatus shown in U.S. Pat. No. 5,005,671 includes spherical shock absorbers for supporting the bottom side of the car body in a car sling and centering elements with cooperating guide pins connected between the top side of the car body and the upper beam of the car sling.

Problem with the prior art is that lateral vibrations caused by guide rails are formed in the upper beam of the sling and although they may be somehow dampened the upper beam may also cause some bending moment which during time will affect to the damping especially in the high speed elevators.

Another problem is that in case of high rise elevators the vibrations of the top side of the elevator car become more relevant for a large range of frequency and if they are not isolated they may induce both lateral vibrations and structure borne noise in the walls of the elevator car.

BRIEF DESCRIPTION OF THE INVENTION

An object of the present invention is to provide an arrangement and an element so as to alleviate the above disadvantages. The objects of the invention are achieved by an arrangement and an element which are characterized by what is stated in the independent claims. The preferred embodiments of the invention are disclosed in the dependent claims.

The invention is based on the idea of damping vibrations in the elevator car caused by joints in guide rails by arranging a damper in a connection element connecting the elevator car body to the elevator car sling. The connection between the elevator car body and the elevator car sling is arranged between a vertical side support of the elevator car sling and the roof of the elevator car body. This is very advantageous because a connection between the upper horizontal support and the roof may cause bending moment and this is prevented in the connection between the side support and the roof. Another advantage of the damping element arranged in the connection element arranged between the vertical side support and the roof is that the stresses in the damping material are share stresses, for which the behaviour of the damping material is optimal.

The elevator car arrangement according to the invention comprises an elevator car body comprising a roof, a bottom and side walls, and an elevator car sling for being guided along vertically extending guide rails. The elevator car sling comprises at least a first vertical side support, a second vertical side support and an upper horizontal support, which said supports are connected to each other to form the sling. The elevator car body is connected to the elevator car sling such that the elevator car body is supported in the elevator car sling. The elevator car arrangement further comprises a connection element for connecting the elevator car body to the elevator car sling such that the connection element is arranged between the roof of the elevator car body and the vertical side support of the elevator car sling and the connection element comprises a damper for damping vibrations caused by guide rails.

The connection element according to the invention for connecting an elevator car body to an elevator car sling to form an elevator car arrangement comprises a first connection part for connecting the connection element to an elevator car sling and a second connection part for connecting the connection element to the elevator car body and a damper which comprises at least a first damper member arranged between the first connection part and the second connection part.

So the connection between the roof of the elevator car and the sling is arranged through a very soft rubber interface in the connection element.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
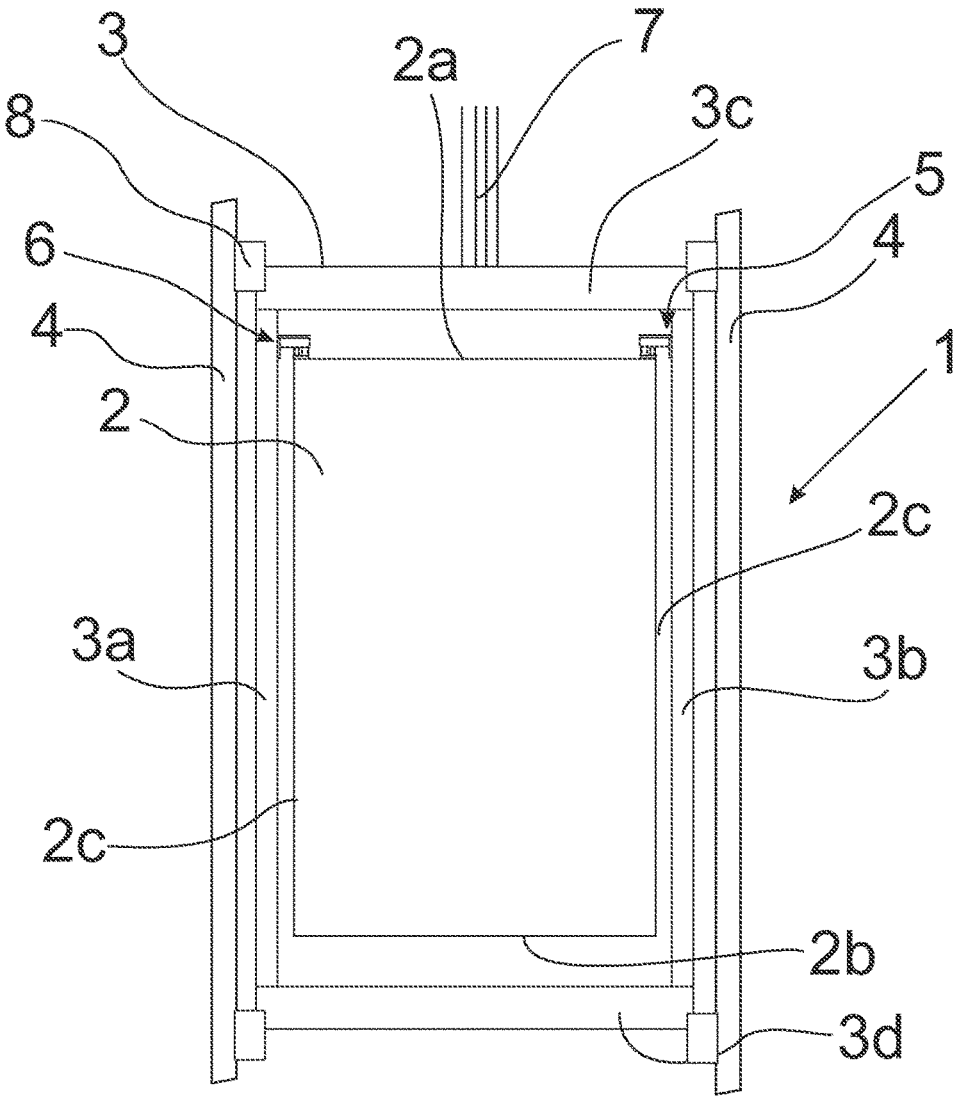
FIG. 1 shows the elevator car arrangement according to the invention.

FIG. 1 shows the elevator car arrangement 1 according to the invention. The elevator car arrangement 1 comprises an elevator car body 2 comprising a roof 2*a*, a bottom 2*b* and side walls 2*c*, and an elevator car sling 3 for being guided along vertically extending guide rails 4. The elevator car sling 3 comprises at least a first vertical side support 3*a*, a second vertical side support 3*b* and an upper horizontal support 3*c*, which said supports 3*a*, 3*b*, 3*c* are connected to each other to form the sling 3. The elevator car body 2 is connected to the elevator car sling 3 such that the elevator car body 2 is supported in the elevator car sling 3. This means that the elevator car sling 3 forms an outer periphery of the elevator car arrangement 1. The elevator car sling may also comprise a lower horizontal support 3*d* but this is not necessary in all elevator car arrangements 1. In the case that the elevator car sling 3 comprises four supports 3*a*, 3*b*, 3*c*, 3*d* they form a closed ring inside which the elevator car body 2 is arranged. The elevator car arrangement 1 further comprises a connection element 5 for connecting the elevator car body 2 to the elevator car sling 3 such that the connection element 5 is arranged between the roof 2*a* of the elevator car body 2 and the vertical side support 3*a*, 3*b* of the elevator car sling 3. The connection element 5 comprises a damper 6 for damping vibrations caused by guide rails 4. The elevator car arrangement 1 moves along guide rails 4 such that the elevator car sling 3 is guided along vertically extending guide rails 4 by means of guide shoes 8 which are arranged adjacent supports 31, 3*b*, 3*c*, 3*d* in the sling 3 and the elevator car arrangement 1 is supported in the elevator shaft by the hoist roping 7.

Figure 2:
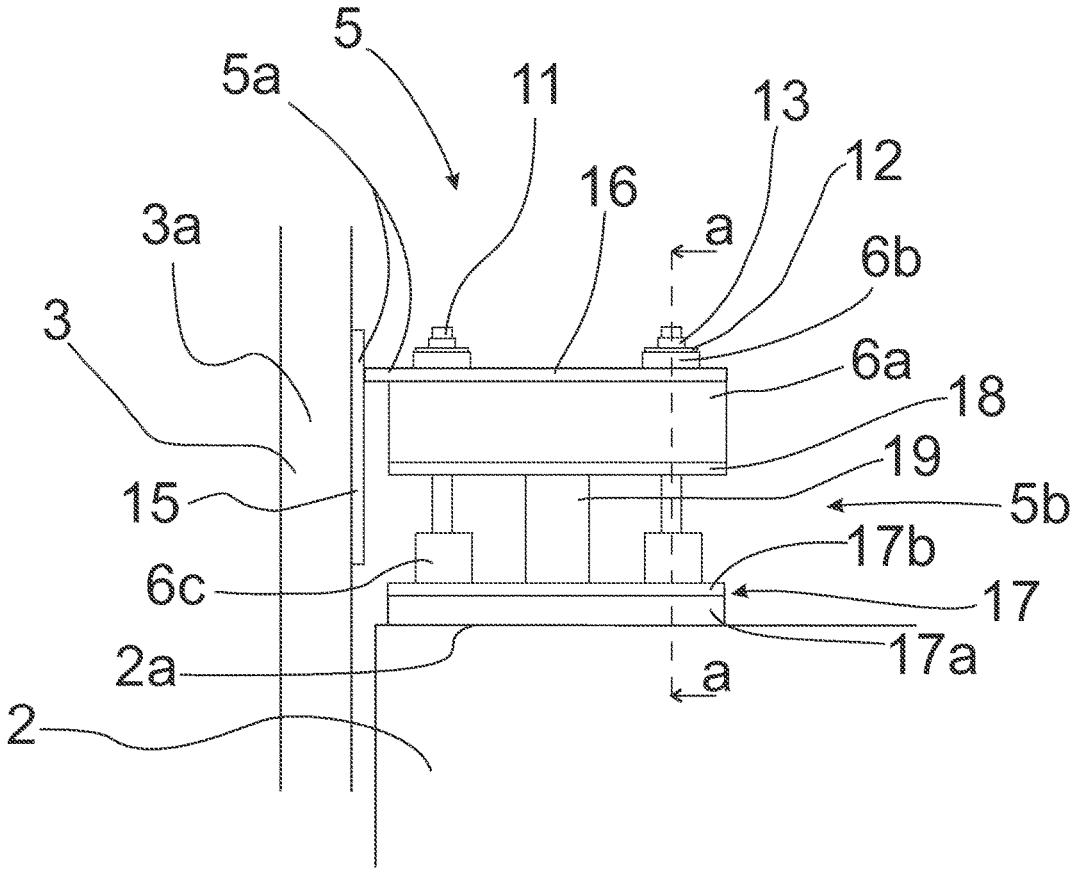
FIG. 2 shows the connection element according to the invention.

FIG. 2 shows that the connection element 5 comprises a first connection part 5*a* connected to the vertical side support 3*a*, 3*b*, a second connection part 5*b* connected to the roof 2*a* of the elevator car body 2 and the damper 6 which is arranged in connection with the first connection part 5*a* and the second connection part 5*b*. The damper 6 comprises at least a first damper member 6*a* arranged between the first connection part 5*a* and the second connection part 5*b*. The first and the second connection part 5*a*, 5*b* are connected together with fastening means 11 such that the first damper member 6*a* is arranged between the first connection part 5*a* and the second connection part 5*b* and the fastening means is arranged to go through both connection parts 5*a*, 5*b* and the first damper member 6*a*.

The first connection part 5*a* comprises a vertical attachment plate 15 connected to the vertical side support 3*a* of the elevator sling 3 and a horizontal attachment plate 16 connected to the vertical attachment plate 15 and extending from the vertical attachment plate 15 toward the opposite vertical side support 3*b* (not shown in FIG. 2) of the elevator car sling 3.

The second connection part 5*b* comprises an attachment part 17 for connecting the second connection part 5*b* to the roof 2*a* of the elevator car body 2 such that the attachment part 17 forms a connection with the roof 2*a*. The second connection part 5*b* further comprises an attachment plate 18 and a cylinder 19 arranged to extend between the attachment part 17 and the attachment plate 18. The cylinder 19 is preferably welded or connected through threaded connection to the attachment part 17 and to the attachment plate 18. The attachment part 17 is preferably formed as a trapezoidal structure having a leg part 17*a* for connecting the second connection part 5*b* to the roof 2*a* and a plate part 17*b* extending from the leg part 17*a* such that the plate part 17*b* is arranged in a distance away from the roof 2*a* of the elevator car body 2. The leg part 17*a* and the plate part 17*b* form a one-piece attachment part 17. The trapezoidal structure of the attachment part 17 is a preferable shape but other shapes of the attachment part 17 are also possible. The form of the attachment part 17 is preferably such that the ends of the fastening means fit between the roof 2*a* and the plate part 17*b* of the attachment part 17.

The first connection part 5*a* and the second connection part 5*b* are connected together with fastening means 11 arranged through both connection parts 5*a*, 5*b* and such that the first damper member 6*a* is arranged between the connection parts 5*a*, 5*b*. In other words, the first damper member 6*a* is arranged between the horizontal attachment plate 16 of the first connection element 5*a* and the attachment plate 18 of the second connection part 5*b*. The first damper member 6*a* extends from the horizontal attachment plate 16 of the first connection element 5*a* to the attachment plate 18 of the second connection element 5*b*. This means that the fastening means 11 are arranged such that they extend through the horizontal attachment plate 16 of the first connection part 5*a*, the first damper member 6 and the attachment plate 18 of the second connection part 5*b* and such that the fastening means 11 extend from the other side of the horizontal attachment plate 16 of the first connection part 5*a* than where the first damper member 6*a* is arranged and the fastening means 11 extend to the other side of the attachment plate 18 of the second connection part 5*b* than where the first damper member 6 is arranged. The fastening means 11 are also preferably extending to the attachment part 17 of the second connection part 5*b* such that the fastening means 11 extend through the plate part 17*b* of the attachment part 17. The first damper member 6*a* may be arranged between the horizontal attachment plate 16 of the first connection part 5*a* and the attachment plate 18 of the second connection part 5*b* such that the first damper member 6*a* does not fill the whole space between the horizontal attachment plate 16 and the attachment plate 18 but there may be additional damper members or plates or other extension brackets too. The damper 6 further preferably comprises a second damper member 6*b* arranged between the horizontal attachment plate 16 and a washer 12 or nut 13 or other fixing means. The fastening means 11 are arranged to go through the second damper member 6*b* similarly as the first damper member 6*a*. The damper 6 further preferably comprises a third damper member 6*c* arranged to extend from one side of the plate part 17*b* of the attachment part 17 to the other side of the plate part 17*b*. The third damper member 6*c* is preferably such that it's diameter is different on one side of the plate part 17*b* than on the other side of the plate part 17*b*. The part of the third damper member 6*c* that is arranged between the plate part 17*b* and a washer 12 or a nut 13 or other fixing means is preferably bigger than the part of the third damper member 6*c* that extends through the hole in the plate part 17*b* and further to the other side of the plate part 17*b* than where the end of the fastening means 11 are.

The material of the damper 6 comprises preferably rubber, and most preferably very soft rubber having a high damping property. The first damper member 6*a* comprises rubber and/or polyurethane with high damping property. The second and third damper member 6*b*, 6*c* comprise rubber or are fully made of rubber. All the damper members 6*a*, 6*b*, 6*c* may comprise different material composition. The material of the damper 6 is required to have a high damping coefficient 0.2 . . . 0.5% and a good creep resistance.

The damper 6 is arranged between the first connection part 5*a* and the second connection part 5*b* in a vertical direction. This means that the first damper member 6*a* is arranged between the horizontal attachment plate 16 of the first connection part 5*a* and the attachment plate 18 of the second connection part 5*b* or at least partly between the horizontal attachment plate 16 of the first connection part 5*a* and the attachment plate 18 of the second connection part 5*b*.

According to the invention the elevator car body 2 is supported in the elevator car sling 3 by the connection elements 5 arranged between the upper corners of the elevator car body 2 and especially between the roof 2*a* of the elevator car body 2 and the vertical side supports 3*a*, 3*b* of the elevator car sling 3. The connection element 5 is attached by its vertical attachment plate 15 to the vertical side support 3*a* of the sling 3 and the first damper member 6*a* is arranged between the horizontal attachment plate 16 of the first connection part 5*a* and the attachment plate 18 of the second connection part 5*b*.

Figure 3:
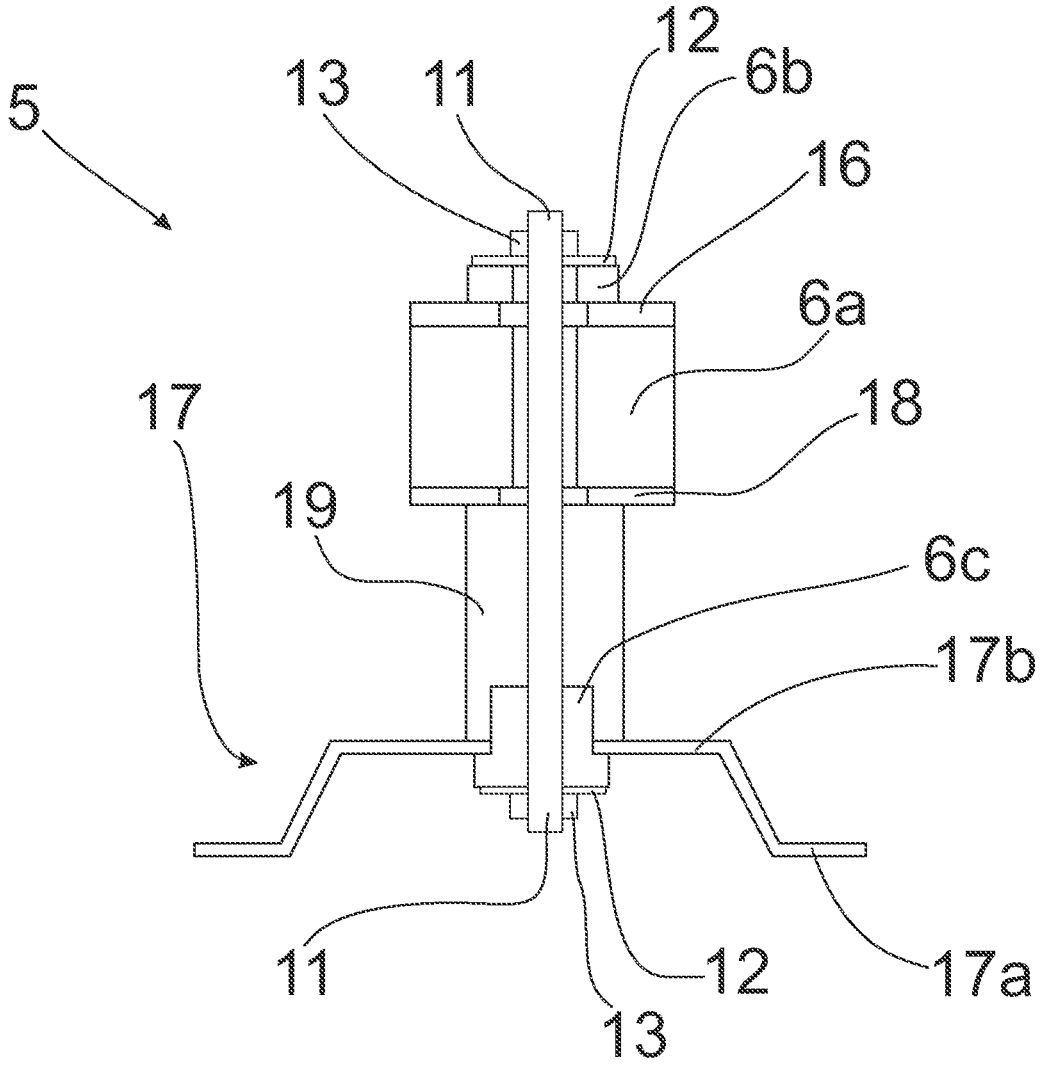
FIG. 3 shows a cross section of the connection element shown in FIG. 2.

FIGS. 2 and 3 show a connection element 5 for connecting an elevator car body 2 to an elevator car sling 3 to form an elevator car arrangement 1. FIG. 3 shows a cross section a-a from FIG. 2 which shows how the third damper member

6*c* extends from one side of the plate part 17*b* of the attachment part 17 to the other side of the plate part 17.

The first connection part 5*a* comprises a vertical attachment plate 15 to be connected to a vertical side support 3*a*, 3*b* of the elevator car sling 3 and a horizontal attachment plate 16 connected to the vertical attachment plate 15 and extending away from the vertical attachment plate 15. In a static position the first damper member 6*a* is not in contact with the fastening means 11 arranged to go through the first damper member 6*a* but during action (eg. when vibrating) the fastening means 11 may contact the first damper member 6*a*. The fastening means 11 are for example a bolt and a nut, a peg and a pin or other suitable fastenings.

The second connection part 5*b* comprises an attachment part 17 to be connected to the roof 2*a* of the elevator car body 2 for connecting the second connection part 5*b* to the roof 2*a*, an attachment plate 18 and a cylinder 19 arranged to extend between the attachment part 17 and the attachment plate 18. The attachment part 17, the cylinder 19 and the attachment plate 18 are connected together preferably by welding or by a threaded coupling or by any other suitable connection that firm.

The first connection part 5*a* and the second connection part 5*b* are connected together with fastening means 11 arranged through the horizontal attachment plate 16 of the first connection part 5*a* and at least through the attachment plate 18 of the second connection part 5*b* and through the first damper member 6*a* arranged to extend between the horizontal attachment plate 16 and the attachment plate 18. The connection element 5 to be connected to the elevator car sling 3 and the elevator car body 2 may comprise before installed into the place the following separate parts: the first connection part 5*a* comprising a vertical attachment plate 15 and a horizontal attachment plate 16 which are connected together for example through welding, the second connection part 5*b* comprising an attachment part 17, an attachment plate 18 and a cylinder 19 which are connected together for example through welding or through a threaded coupling, a damper 6 comprising at least a first damper member 6*a* and fastening means 11 comprising for example a bolt and a nut. On the other hand the connection element 5 may be preassembled such that the above mentioned part are already assembled together and the vertical attachment plate 15 will then be connected to the elevator car sling 3 and the attachment part 17 will be connected to the roof 2*a* of the elevator car body 2.

As already explained previously the first damper member 6*a* comprises rubber and/or polyurethane and the second and third damper member 6*b*, 6*c* are rubber.

It will be obvious to a person skilled in the art that, as the technology advances, the inventive concept can be implemented in various ways. The invention and its embodiments are not limited to the examples described above but may vary within the scope of the claims.

The invention claimed is:

1. An elevator car arrangement, comprising:

an elevator car body comprising a roof, a bottom and side walls;

an elevator car sling for being guided along vertically extending guide rails, said elevator car sling comprising at least a first vertical side support, a second vertical side support and an upper horizontal support, which said supports are connected to each other to form the sling, wherein the elevator car body is connected to the elevator car sling such that the elevator car body is supported in the elevator car sling; and a connection element for connecting the elevator car body to the elevator car sling such that the connection element is connected above the roof of the elevator car body and to the vertical side support of the elevator car sling, wherein the connection element comprises a damper for damping vibrations caused by guide rails, wherein the connection element further comprises a first connection part connected to the vertical side support and a second connection part connected to the roof of the elevator car body, wherein the damper comprises at least a first damper member arranged between the first connection part and the second connection part, wherein the first connection part comprises a horizontal attachment plate and the second connection part comprises an attachment plate, an attachment part and a cylinder, and wherein the first damper member is arranged at least partly between the horizontal attachment plate of the first connection part and the attachment plate of the second connection part, wherein the attachment part is configured for connecting the second connection part to the roof of the elevator car body, and wherein a first end of the cylinder is configured to contact the attachment part and a second end of the cylinder, opposite to the first end, is configured to contact the attachment plate, wherein the damper comprises a second damper member in connection with the first connection part and arranged on the other side of the horizontal attachment plate of the first connection part than the first damper member and such that a fastener is arranged to go through the second damper member, wherein the damper comprises a third damper member in connection with the second connection part and the third damper is arranged to extend from one side of a plate part of the attachment part, through a hole of the plate part, and to the other side of the plate part, and wherein the first damper member comprises rubber and/or polyurethane and the second damper member and the third damper member comprises rubber.

2. The elevator car arrangement according to claim 1, wherein the first connection part comprises a vertical attachment plate connected to the vertical side support and the horizontal attachment plate extending from the vertical attachment plate.

3. The elevator car arrangement according to claim 1, wherein the attachment part is formed as a trapezoidal structure having a leg part for connecting the second connection part to the roof and the plate part extending from the leg part such that the plate part is arranged in a distance away from the roof of the elevator car body.

4. The elevator car arrangement according to claim 3, wherein the first connection part and the second connection part are connected together with the fastener arranged through the horizontal attachment plate of the first connection part and at least through the attachment plate of the second connection part and through the first damper member arranged to extend between the horizontal attachment plate and the attachment plate.

5. The elevator car arrangement according to claim 1, wherein the first connection part and the second connection part are connected together with the fastener arranged through the horizontal attachment plate of the first connection part and at least through the attachment plate of the second connection part and through the first damper member arranged to extend between the horizontal attachment plate and the attachment plate.

6. A connection element for connecting an elevator car body to an elevator car sling to form an elevator car arrangement, comprising:

a first connection part comprising a horizontal attachment plate for connecting the connection element to the elevator car sling;

a second connection part comprising an attachment plate, an attachment part, and a cylinder for connecting the connection element to the elevator car body; and a damper comprising at least a first damper member arranged between the first connection part and the second connection part, wherein the attachment part is configured to be connected to a top surface of a roof of the elevator car body for connecting the second connection part to the roof, wherein a first end of the cylinder is configured to contact the attachment part and a second end of the cylinder, opposite to the first end, is configured to contact the horizontal attachment plate, wherein the damper comprises a second damper member in connection with the first connection part and arranged on the other side of the horizontal attachment plate of the first connection part than the first damper member and such that a fastener is arranged to go through the second damper member, wherein the damper comprises a third damper member in connection with the second connection part and the third damper is arranged to extend from one side of a plate part of the attachment part, through a hole of the plate part, and to the other side of the plate part, and wherein the first damper member comprises rubber and/or polyurethane and the second damper member and the third damper member comprises rubber.

7. The connection element according to claim 6, wherein the first connection part comprises a vertical attachment plate to be connected to a vertical side support of the elevator car sling and the horizontal attachment plate connected to the vertical attachment plate and extending away from the vertical attachment plate.

8. The connection element according to claim 7, wherein the first connection part and the second connection part are connected together with the fastener arranged through the horizontal attachment plate of the first connection part and at least through the attachment plate of the second connection part and through the first damper member arranged to extend between the horizontal attachment plate and the attachment plate.

* * * * *